US005444955A

United States Patent [19]

Ou

[11] Patent Number: 5,444,955

[45] Date of Patent: Aug. 29, 1995

[54] COMBINATION WALL

[75] Inventor: Yang-Chiu Ou, Nantou, Taiwan

[73] Assignee: An Shun Enterprise Co., Ltd., Nantou, Taiwan

[21] Appl. No.: 188,759

[22] Filed: Jan. 31, 1994

[51] Int. Cl.[6] ..... E04C 1/00

[52] U.S. Cl. ..... 52/309.9; 52/220.7; 52/811; 52/829; 52/267; 52/797.1

[58] Field of Search ..... 52/220.7, 309.9, 309.14, 52/793, 811, 829, 267, 268, 269

[56] References Cited

U.S. PATENT DOCUMENTS

| | | | |
|---|---|---|---|
| 3,254,464 | 6/1966 | Hoyt, Jr. | 52/309.9 |
| 3,334,464 | 8/1967 | Charles | 52/309.9 X |
| 3,802,146 | 4/1974 | Tacke et al. | 52/220.7 X |
| 3,924,369 | 12/1975 | Guarino | 52/220.7 X |
| 4,671,032 | 6/1987 | Reynolds | 52/309.9 X |
| 4,706,422 | 11/1987 | Ashton | 52/220.7 X |
| 5,081,810 | 1/1992 | Emmert | 52/309.9 X |
| 5,279,089 | 1/1994 | Gulur | 52/309.9 X |

*Primary Examiner*—Carl D. Friedman
*Assistant Examiner*—Beth A. Aubrey
*Attorney, Agent, or Firm*—Browdy and Neimark

[57] ABSTRACT

An improved combination wall is composed of a foundation member, two foam boards and two face boards. The foundation member has two wall boards spaced in a parallel manner. Located between the two wall boards are a plurality of partition boards arranged at an interval such that the partition boards are parallel to one another, and that the partition boards are perpendicular to the two wall boards, and further that both sides of each of the partition boards are fastened respectively with inner surfaces of the two wall boards. The two foam boards are fastened respectively with the outer surfaces of the two wall boards. The two face boards are fastened respectively with the outer surfaces of the two foam boards.

4 Claims, 7 Drawing Sheets

COMBINATION WALL

FIELD OF THE INVENTION

The present invention relates generally to a building structure, and more particulary to an improved combination wall.

BACKGROUND OF THE INVENTION

The traditional wall is generally made of bricks or steel-reinforced concrete. Such conventional wall is heavy in weight and can not be removed easily to facilitate the remodeling of a structure. The wooden wall is generally poor in sound insulation and catches fire easily.

SUMMARY OF THE INVENTION

The primary objective of the present invention is therefore to provide an improved combination wall, which is light in weight, soundproof, fireproof, and heat-insulating. In addition, such an improved combination wall as mentioned above can be easily constructed.

The foregoing objective of the present invention is attained by the improved combination wall which comprises a foundation member, two foam boards, and two face boards. The foundation member has two wall boards spaced in a parallel manner. Located between the two wall boards are a plurality of partition boards spaced in a parallel manner such that the partition boards are perpendicular to the wall boards, and that both sides of each of the partition boards are fastened respectively with the inner surfaces of the two wall boards. The two foam boards are fastened respectively with the outer surfaces of the two wall boards of the foundation member. The two face boards are fastened respectively with the outer surfaces of the two foam boards.

DETAILED DESCRIPTION OF THE INVENTION

Figure 1:
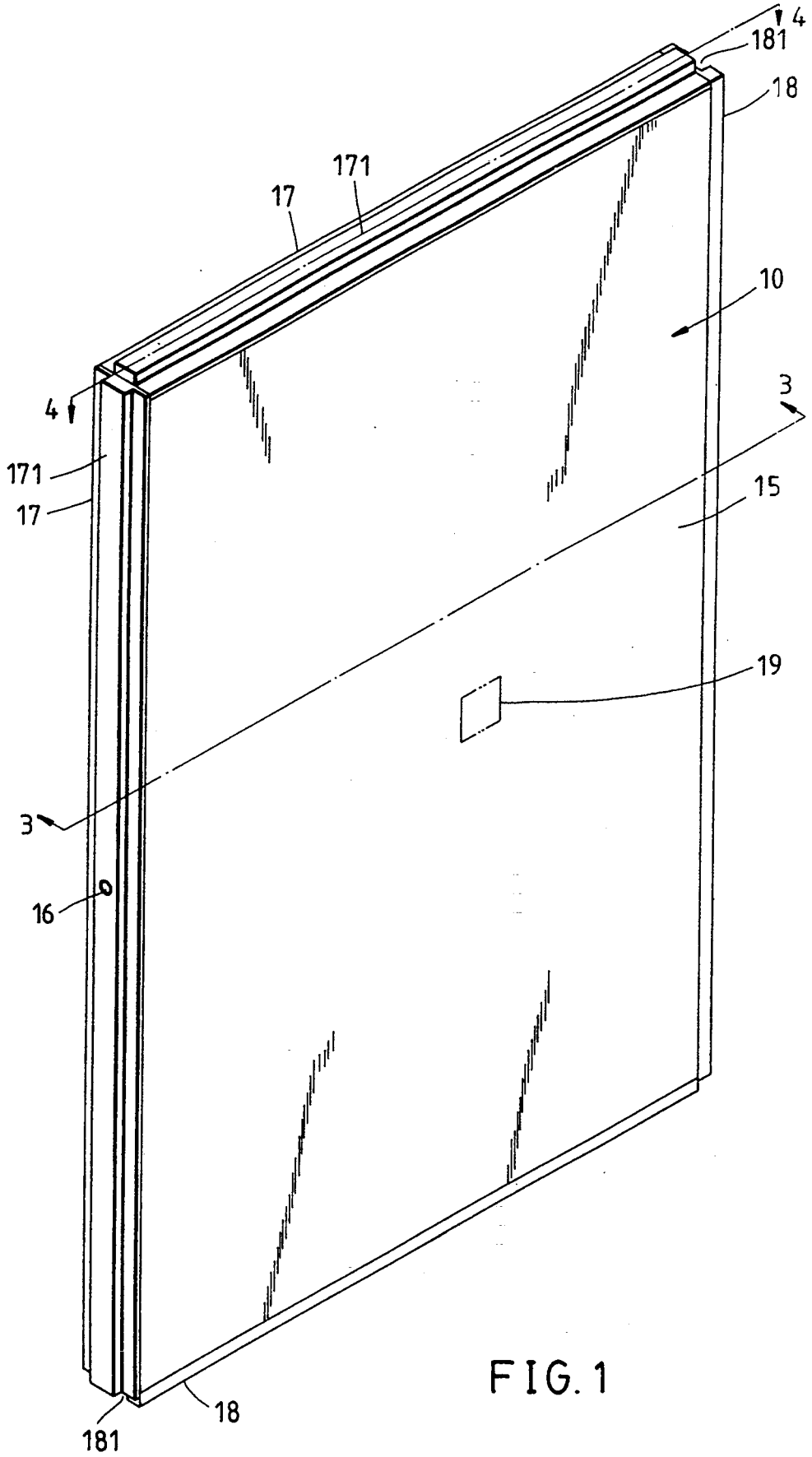
FIG. 1 shows a perspective view of a first preferred embodiment of the present invention.
Figure 2:
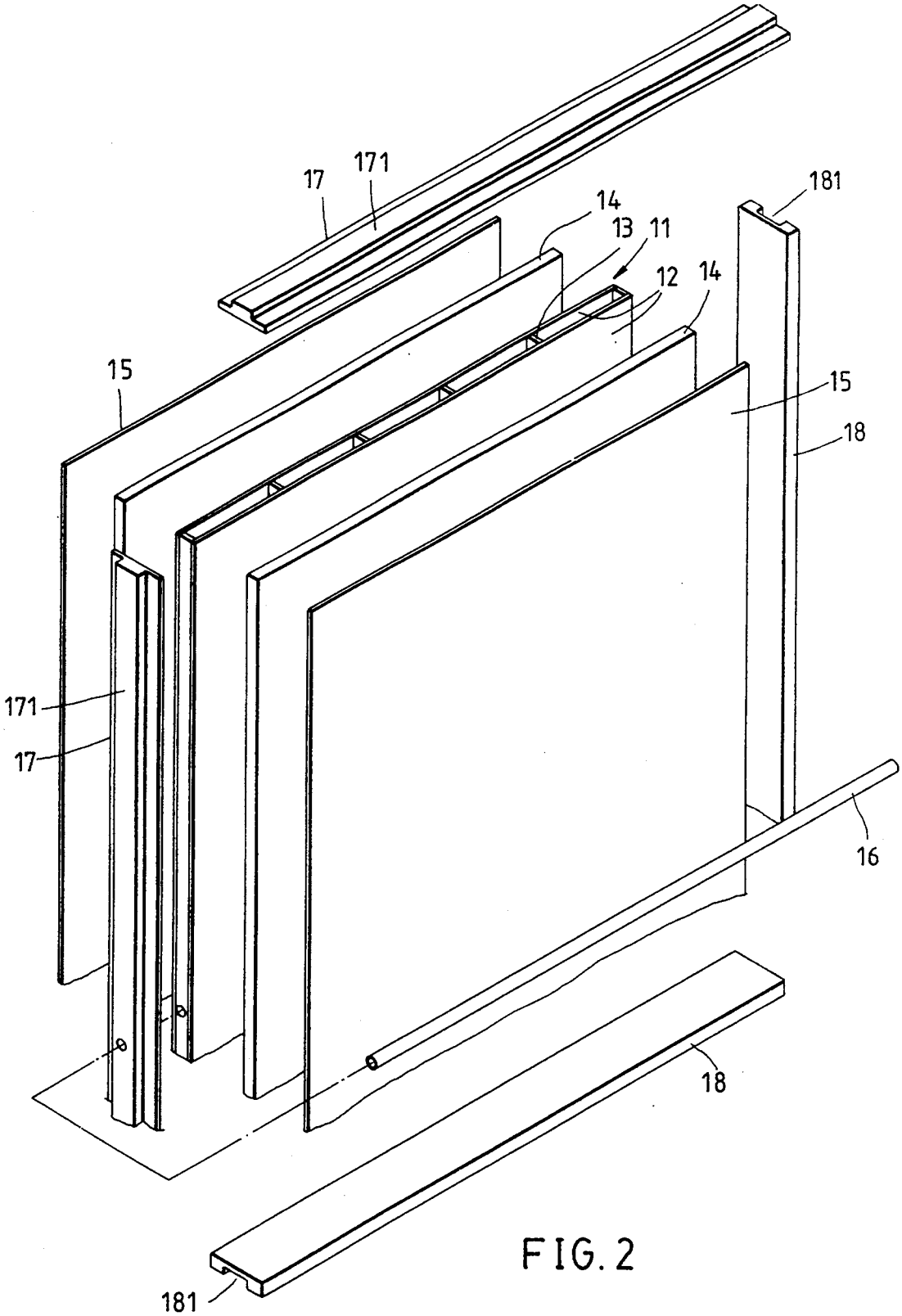
FIG. 2 shows an exploded view of the first preferred embodiment of the present invention.
Figure 3:
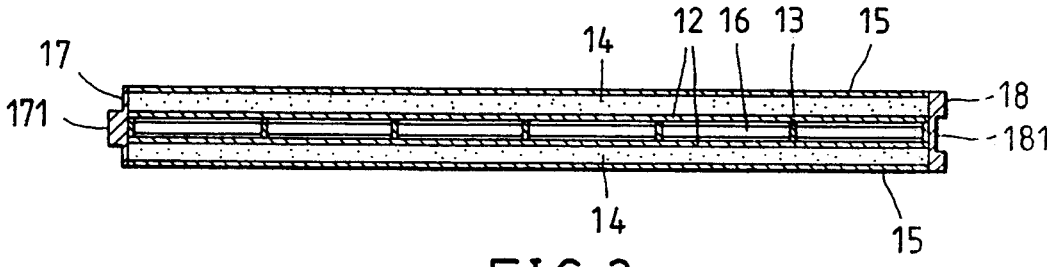
FIG. 3 sows a sectional view of a portion taken along the line 3—3 as shown in FIG. 1.
Figure 4:
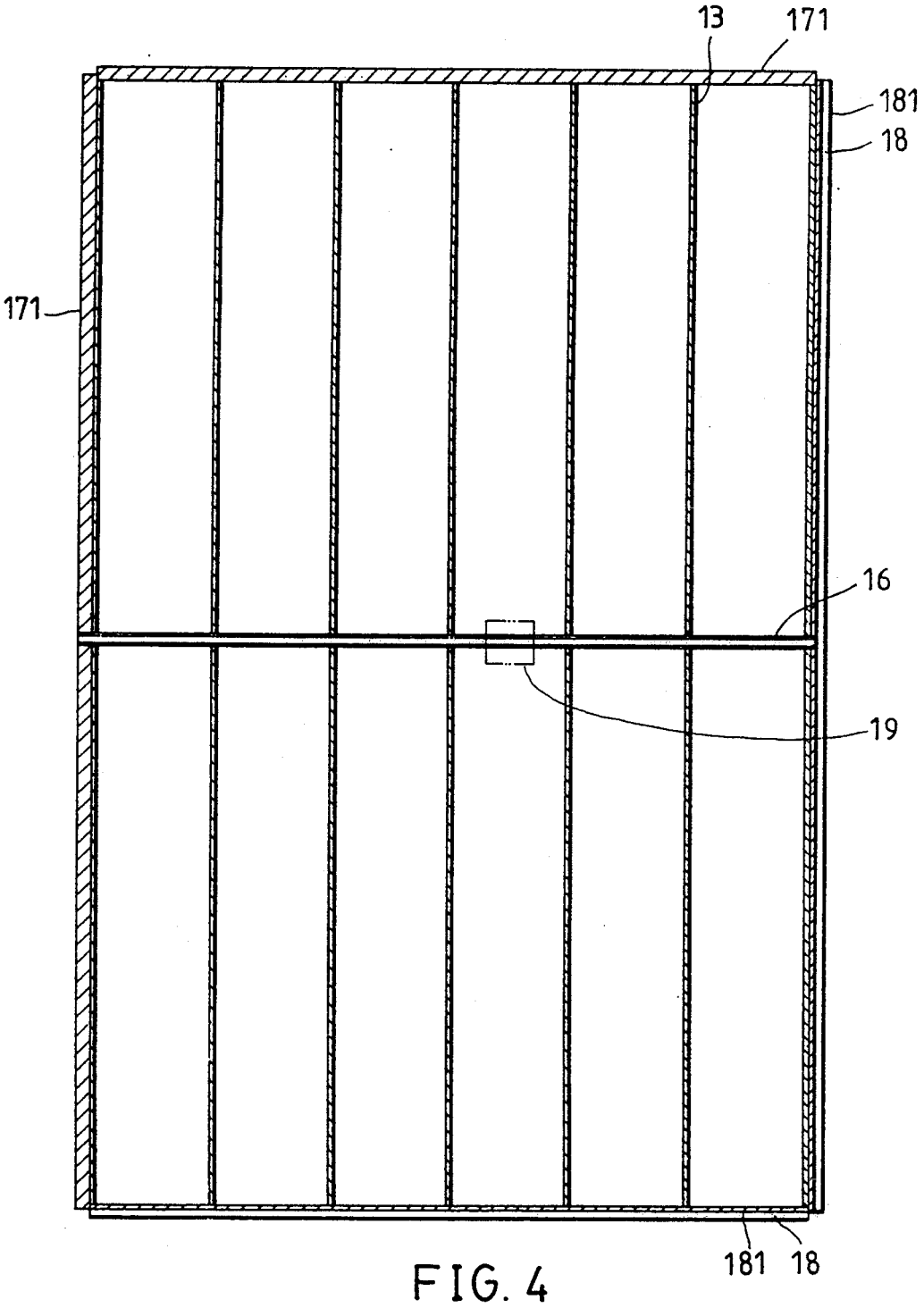
FIG. 4 shows a sectional view of a portion taken along the line 4—4 as shown in FIG. 1.

Referring to FIGS. 1-4, a wall 10 of the first preferred embodiment of the present invention is shown to comprise a foundation member 11, two foam boards 14, two face boards 15, an inner pipe 16, and four side boards 17 and 18.

The foundation member 11 has two wall boards 12 spaced in a parallel manner. Located between the two wall boards 12 are a plurality of partition boards 13 which are also spaced in a parallel manner and are perpendicular to the wall boards 12. Both sides of each of the partition boards 13 are fastened respectively with the inner sides of the two wall boards 12. The foundation member 11 may be made of wooden boards or plastic boards. In addition, the foundation member 11 may be made integrally of a plastic material by extrusion.

Each of the two foam boards 14 has considerable hardness and thickness and is fastened respectively with the outer surfaces of the two wall boards 12. The foundation member 11 may be made of wooden boards or plastic boards. In addition, the foundation member 11 may be made integrally of a plastic material by extrusion.

Each of the two foam boards 14 has considerable hardness and thickness and is fastened respectively with the outer surfaces of the two wall boards 12 of the foundation member 11. The foam boards 14 of the first preferred embodiment of the present invention are made of PVC foam material and provided with a plurality of independent cells. As a result, the foam boards 14 are light in weight, soundproof, fireproof, and heat-insulating. The foam boards 14 are used to increase the thickness of the wall 10 and to enhance the soundproof and the heat-insulating effects of the wall 10.

The two face boards 15 are adhered securely and respectively to the surfaces of the two foam boards 14 for forming the two surfaces of the wall 10. The face boards 15 are made of a synthetic plywood, a fiber-reinforced resin board, a plastic board, a metal board, a slate (such as a marble plate, a calcium silicate plate, etc.), or a wooden plate. The two face boards 15 may be made of the same material or the different materials. If the wall 10 is used as a partition wall, the two face boards 15 of the wall 10 may be made of the same material, such as the resin board reinforced by the natural fiber. If the wall 10 is used as an outer wall, the two face boards 15 of the wall 10 may be made of the different materials, such as the slate, the metal board, or the plastic board having the stone grain and made from the recycled food and beverage containers of PET. In addition, the face boards 15 may be given a certain kind of surface of paint, or electroplated, or printed theron with wood grain or stone grain, or covered with wall papers.

The inner pipe 16 is disposed between the two wall boards 12 such that the inner pipe 16 is perpendicular to the partition boards 13. The inner pipe 16 is intended for use in wiring.

The four side boards 17 and 18 are adhered securely and respectively to four sides of the wall 10. The two opposite side boards 17 and 18 are provided respectively with a rib 171 and a slot 181, which are engageable securely with each other and are intended for use in joining two or more walls 10 together. Both ends of the inner pipe 16 are put through the left and the right side boards 17 and 18.

The wall 10 is provided in the surface thereof with a through hole 19 communicating with the inner pipe 16 for installing a switch or socket.

Figure 5:
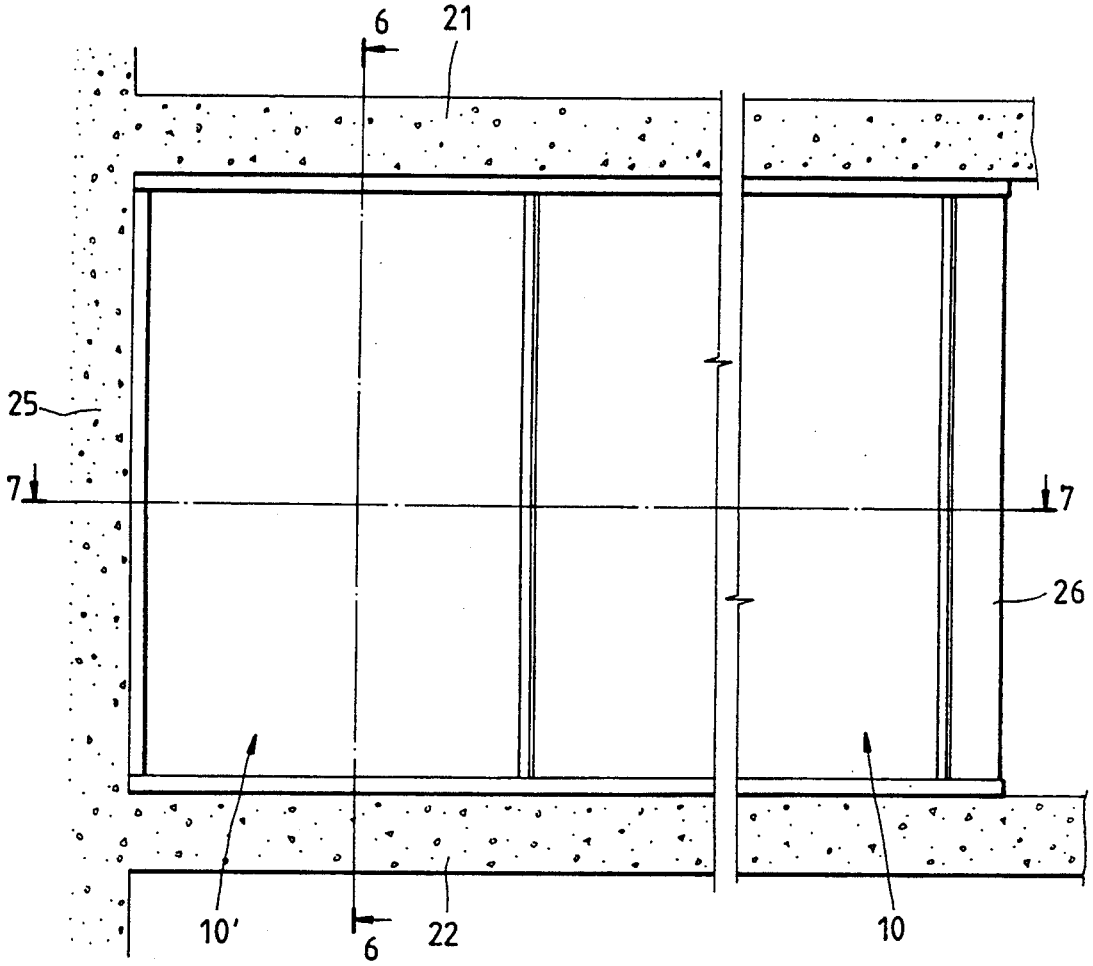
FIG. 5 shows a schematic view of the first preferred embodiment at work, according to the present invention.
Figure 6:
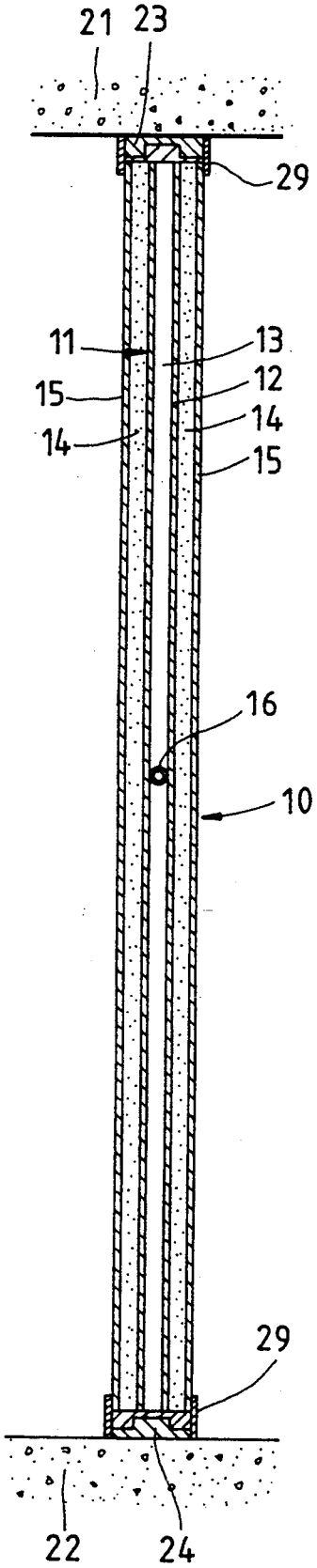
FIG. 6 shows a sectional view of a portion taken along the line 6—6 as shown in FIG. 5.
Figure 7:
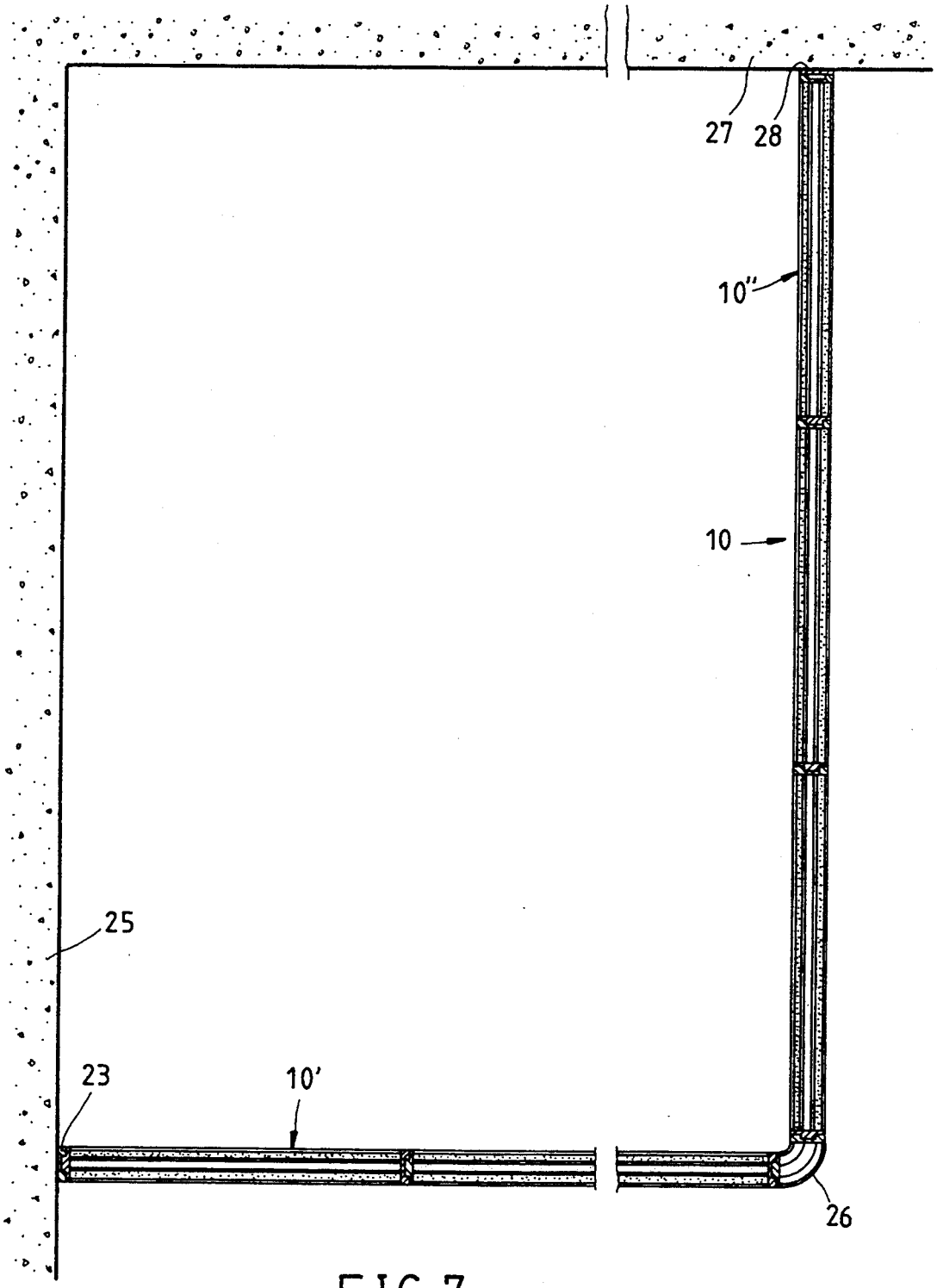
FIG. 7 shows a sectional view of a portion taken along the line 7—7 as shown in FIG. 5.

As shown in FIGS. 5, 6 and 7, the combination wall 10 is constructed by providing first a top wall 21 and a floor 22 respectively with guide rails 23 and 24, which are complementary in shape with the side boards 17 and 18. One end wall 25 is provided thereon with a guide rail 23 for fastening a first wall 10'. The corners may be connected with the curved joints 26 made of a plastic or metal material by extrusion. Disposed securely between a last wall 10" and another end wall 27 is a flat insertion board 28. It is not provided with the upper guide rail 23 between the top end of the last wall 10" and the top wall 21. The seams among the walls 10 may be sealed off with the sand glue or the rubber strips. The ornamental boards 29 are disposed between the wall and the upper and the lower guide rails 23 and 24.

Figure 8:
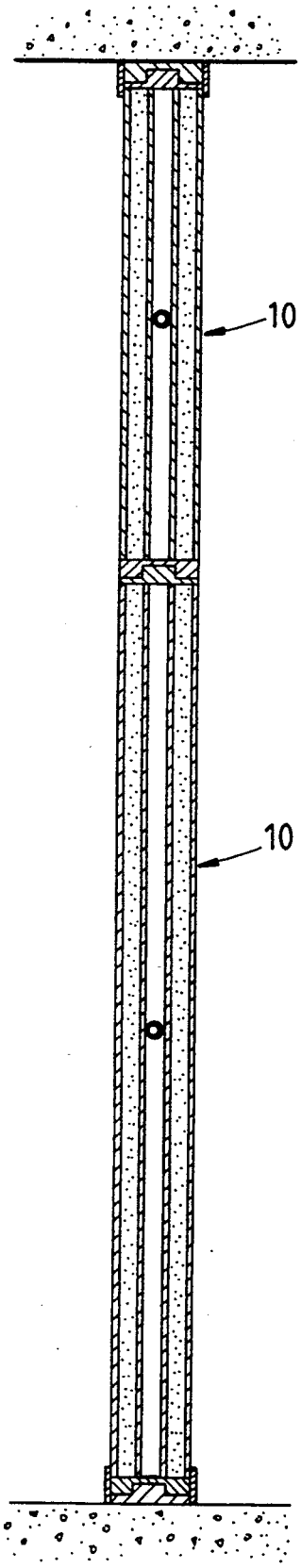
FIG. 8 is another schematic view of the first preferred embodiment of the present invention at work, showing that the walls are joined together in an end-to-end manner.

As shown in FIG. 8, the walls 10 may be joined together in an end-to-end manner.

Figure 9:
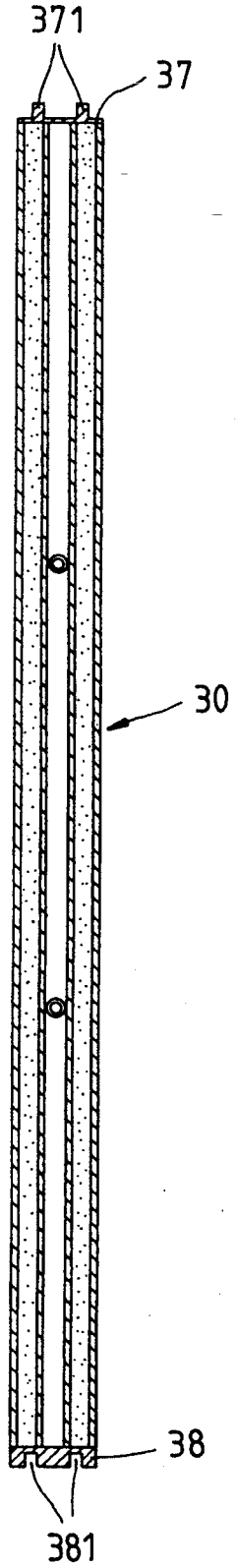
FIG. 9 shows a sectional view of a second preferred embodiment of the present invention.

As shown in FIG. 9, a wall 30 of the second preferred embodiment of the present invention is generally similar in construction to the wall 10 of the first preferred embodiment of the present invention, with the difference being that the former has side boards 37 and 38, which are provided respectively with a rib 371 and a slot 381, and two inner pipes 36. The walls 10 and 30 are constructed in the ways that are similar to each other.

Figure 10:
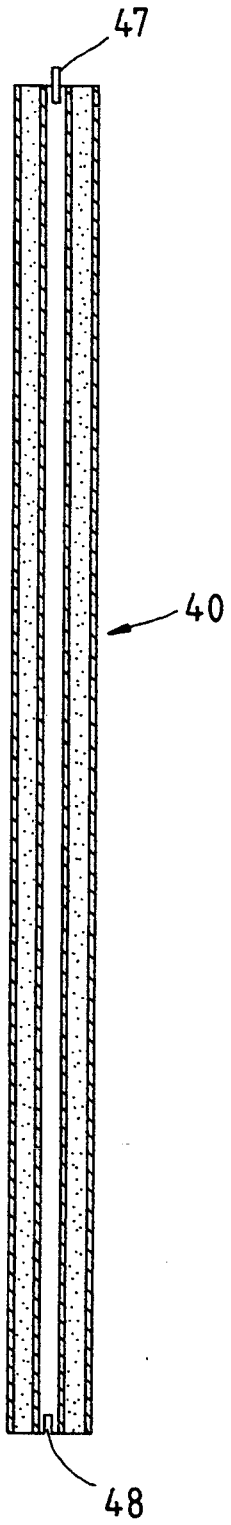
FIG. 10 shows a sectional view of a third preferred embodiment of the present invention.

A wall 40 of the third preferred embodiment of the present invention is devoid of side boards, as shown in FIG. 10, and is provided with a metal insertion board 47 and a slot 48.

The combination walls of the present invention are light in weight and can be transported easily and economically. The space between the two partition boards and the inner pipes can be used for wiring. The foam boards and the foundation member are heat-insulating, soundproof and fireproof and have respectively a considerable thickness. The walls of the present invention can be put into use in conjunction with the existing doors and windows. Furthermore, the walls of the present invention can be built or removed easily and rapidly.

What is claimed is:

1. An improved wall comprising:

a foundation member having two wall boards, each having inner and outer surfaces spaced in a parallel manner, said foundation member further having a plurality of partition boards arranged at an interval and in a parallel manner between said two wall boards, said partition boards being perpendicular to said two wall boards, with both sides of each of said partition boards being fastened to an inner surface of each of said two wall boards;

two foam boards fastened respectively to an outer surface of each of said two wall boards; and two face boards fastened respectively to an outer surface of each of said two foam boards.

2. The improved wall of claim 1 wherein said foundation member is provided with a predetermined number of an inner pipe arranged in a direction perpendicular to said partition boards.

3. The improved wall of claim 1 wherein at least one surface of one of said two face boards is provided with a predetermined number of a through hole corresponding in location to said inner pipe and communicating with said inner pipe.

4. The improved wall of claim 1 further comprising four sides, with two pair of opposite sides being provided respectively with a rib and a slot which are engageable securely with each other.

* * * * *